United States Patent [19]

Maurice et al.

[11] Patent Number: 4,481,397

[45] Date of Patent: Nov. 6, 1984

[54] APPARATUS FOR THE MAGNETIC INDUCTION HEATING OF FLAT, RECTANGULAR METAL PRODUCTS TRAVELING IN THEIR LONGITUDINAL DIRECTION

[75] Inventors: Jean Maurice, Paris; Roger Travers, Chatenay-Malabry; Jean-Paul Camus, Mantes la Jolie, all of France

[73] Assignee: CEM Compagnie Electro Mecanique, Paris, France

[21] Appl. No.: 441,094

[22] Filed: Nov. 12, 1982

[30] Foreign Application Priority Data

Nov. 13, 1981 [FR] France ..... 81 21238

[51] Int. Cl.[3] ..... H05B 6/10

[52] U.S. Cl. ..... 219/10.61 R; 219/10.75; 219/10.79; 219/10.57; 219/10.43

[58] Field of Search ..... 219/10.61 R, 10.61 A, 219/10.49 R, 10.49 A, 10.79, 10.57, 10.67, 10.71, 10.75, 10.43, 10.69

[56] References Cited

U.S. PATENT DOCUMENTS 3,236,993 2/1966 Jones ..... 219/10.79 X 3,272,956 9/1966 Baermann ..... 219/10.49 R

*Primary Examiner*—P. H. Leung

*Attorney, Agent, or Firm*—Burns, Doane, Swecker & Mathis

[57] ABSTRACT

Magnetic induction heating apparatus for flat, rectangular metal products travelling in the direction of their longitudinal axis, comprising at least one inductor mounted so as to rotate about an axis perpendicular to a wide face of the metal product and comprising at least two magnetic poles having polar surfaces sweeping out an annular area as the inductor rotates about the perpendicular axis. In order to effectuate the homogeneous heating of the metal product in the transverse direction, the polar surface of each magnetic pole has the shape of a curvilinear triangle with a truncated apex directed toward the axis of rotation of the inductor, two concave sides which are symmetric with respect to a straight line passing through the truncated apex and perpendicular to the axis of rotation, and a convex side of circular arc centered about the axis of rotation having a radius of curvature essentially equal to the external radius of the annular area sweep by the polar surfaces of the magnetic poles.

5 Claims, 6 Drawing Figures

APPARATUS FOR THE MAGNETIC INDUCTION HEATING OF FLAT, RECTANGULAR METAL PRODUCTS TRAVELING IN THEIR LONGITUDINAL DIRECTION

BACKGROUND OF THE INVENTION

1. Field of the Invention

The present invention concerns an apparatus for the magnetic induction heating of rectangular, flat metal products traveling along their longitudinal axis. The apparatus is of a type comprising at least one inductor capable of producing a controllable magnetic field of constant intensity, oriented essentially perpendicularly to a wide face of the metal product to be heated. The inductor is mounted so as to rotate about an axis perpendicular to the wide face of the metal product and comprises at least two magnetic poles having polar surfaces facing the wide face and parallel to it. The magnetic poles sweep an annular area as the inductor rotates about the axis perpendicular to the wide face of the metal product.

The use of rotating inductors to generate a magnetic field of constant but controlled intensity to heat metal products to be hot worked has been known for a long period to time (see for example French Pat. Nos. 916,287 and 1,387,635). The magnetic poles may consist of permanent magnets, electromagnets or a combination of permanent and electromagnets. The inductor or inductors may be placed externally about a refractory tunnel of a material permeable by the magnetic field through which the metal products to be heated are passing.

The known devices for induction heating have seldom been previously used for the reheating of metal products, such as slabs or blooms, i.e. when the slabs have already undergone several passes through the roughing stands of a rolling mill, but not the finishing stands of the mill. In addition, experience has shown that it is difficult to obtain a regular temperature profile in the transverse direction of the metal products to be reheated with the previously known heating devices. This problem becomes even more complex in view of the fact that the metal products to be heated may have widths varying over a wide range of values.

OBJECT AND BRIEF SUMMARY OF THE INVENTION

It is therefore the object of the present invention to solve this problem by providing an improved magnetic induction heating apparatus to improve the homogeneity of heating in the transverse direction of metal products passing in their longitudinal direction, regardless of the width of the metal products within a given range.

For this purpose, the magnetic induction heating apparatus according to the present invention is characterized in that the polar surface of each pole has the form of a curvilinear triangle having an apex directed toward the axis of rotation of the inductor. Two sides of the curvilinear triangle are concave and symmetrical with respect to a straight line passing through the apex and perpendicular to the axis about which the inductor rotates. The third side of the curvilinear triangle has the shape of convex circular arc centered on the axis about which the inductor rotates and having a radius of curvature essentially equal to the external radius of the annular zone swept by the polar surfaces of the poles.

BRIEF DESCRIPTION OF THE DRAWINGS

The present invention and its objects and advantages will become more apparent from the following description of a preferred embodiment, presented with reference to the drawings attached hereto, in which.

DETAILED DESCRIPTION

Figure 1:
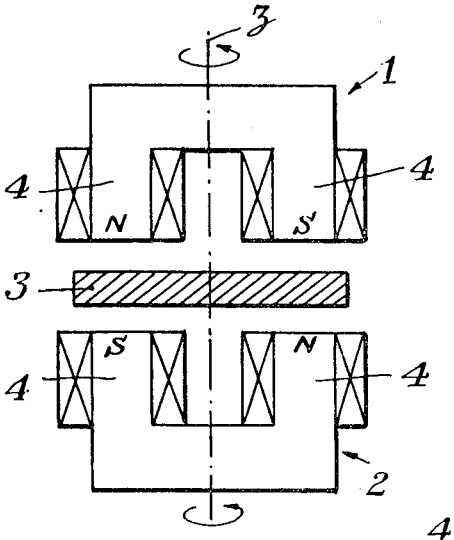
Fig. 1 PRIOR ART
FIG. 1 shows schematically, in a transverse section, a conventional magnetic induction heating apparatus.

A conventional magnetic induction heating apparatus to which the present invention may be applied is shown schematically in FIG. 1. As an example, the apparatus comprises two inductors 1 and 2, placed respectively above and below a rectangularly shaped metal product 3 to be heated. The metal product, typically of slab like geometry, moves continuously in a direction perpendicular to the plane of the figure, i.e. in the direction of its length. As shown in FIG. 1, each of the two inductors comprises several magnetic poles, for example two magnetic poles 4. Depending on the heating intensity that is to be obtained and the ambient temperature in the vicinity of the inductors 1 and 2, the poles 4 may consist of permanent magnets, electromagnets, or of permanent magnets surrounded by coils capable of being supplied with direct current. In the case where electromagnets or permanent magnets equipped with coils are used, the intensity of the direct current may be regulated in a known manner in order to control the intensity of the magnetic field produced by the magnets and, consequently, the intensity of heating generated by the induced currents in the metal product 3 to be heated. Usually the poles 4 have a circular cross section (this shape corresponds to a maximum magnetic flux for a given length of a conductor and thus to a given Joule loss in the case of coil poles).

Figure 2:
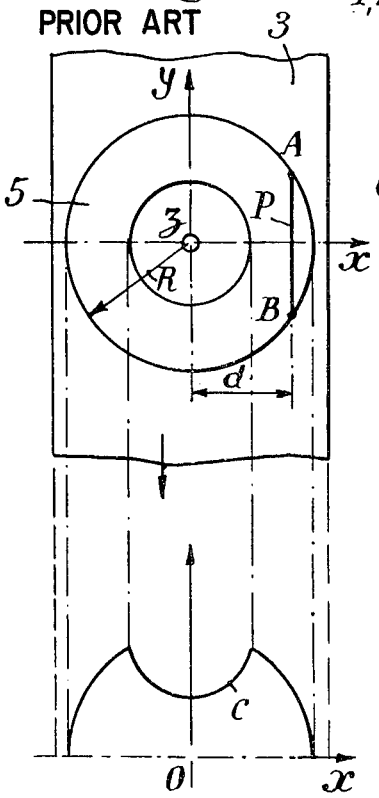
Fig. 2 PRIOR ART
FIG. 2 shows the annular zone of action of the heating apparatus of FIG. 1 on the metal product to be heated, together with the heating profile obtained in the transverse direction of the metal product.

At least one of the inductors 1 and 2 is entrained in rotation around the vertical axis z by known means, not shown in FIG. 1, with the other inductor capable of being entrained in rotation synchronously by the same means of entrainment or by the magnetic field produced in the first inductor. The rotational speed of the inductors 1 and 2 is usually substantially higher than the rate of advance of the metal product 3. During this rotational movement, the polar surfaces of the poles 4, located perpendicularly to face the wide faces of the metal product 3, sweep an annular zone 5, as shown in FIG. 2. This zone 5 corresponds roughly to the zone of action of the inductors on the metal product 3 to be heated. If the product 3 were stationary, the thermal energy applied to it by means of the Joule effect of the induced currents in its mass would be relatively homogeneous in the annular zone 5. However, as the metal product 3 is moving past the inductors, the thermal energy applied at point P located at a distance d from the median longitudinal axis of the product 3 is proportional to the duration of the presence of the point P in the annular action zone 5 of the inductors, with this duration itself being proportional to the length of the segment AB shown in FIG. 2. At the bottom of FIG. 2, the heating profile C obtained with such a heating apparatus in the transverse direction of the metal product 3, is displayed. As may be seen from the heating profile C shown in FIG. 2, a heating apparatus such as that represented in FIG. 1 having dimensions such that the external diameter of its annular action zone 5 essentially corresponds with the width of the metal product 3 to be heated does not provide homogeneous heating over the entire width of the product 3 during its advance. In order to obtain an approximately homogeneous heating in actual practice, it is necessary to use a heating apparatus having dimensions such that the external diameter of its annular action zone 5 is substantially larger than the maximum width of the metal products 3 to be heated, so as to operate in the median part of the heating profile C. One is thus forced to use heating devices having large dimensions with respect to the width of the metal products 3 to be heated. Devices of such dimensions have a lower efficiency since the magnetic flux produced by the larger inductors is not fully utilized for heating. This is because the magnetic flux produced by the inductors is not acting on the metal products 3 to be heated when, in the course of their rotation, the magnetic poles are outside the longitudinal sides of the metal product.

Figure 3:
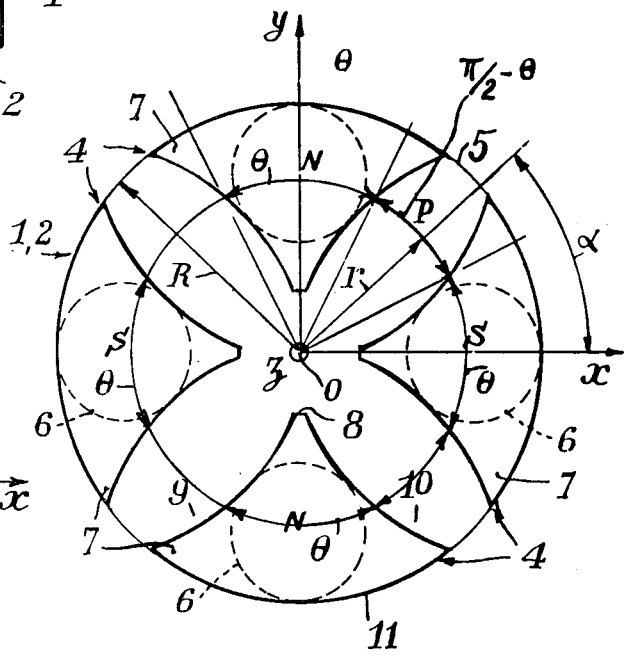
FIG. 3 shows the form of the polar surfaces of the magnetic poles of a heating apparatus according to the present invention.

The present invention makes it possible to remedy this condition by providing a heating apparatus having dimensions such that the outer diameter of its zone of action is only slightly larger than the maximum width of the metal products to be heated and which heats said products in an essentially homogeneous manner over their entire width with a high efficiency. According to the present invention, this result may be obtained by using one or two inductors placed in a manner similar to those of FIG. 1, but with their magnetic poles consisting of electromagnetics, for example, having polar surfaces in the shape of curvilinear triangles. FIG. 3 shows an example in frontal elevation of an inductor according to the present invention comprising four magnetic poles 4 of identical configuration and with alternating polarities. Each magnetic pole 4 may contain a magnetic core 6 of a circular transverse cross section, for example, around which is placed an excitation winding (not shown) supplied with direct current. Each core 6 is equipped with a pole shoe or polar piece 7, which is an integral part of the core 6 or which may be fastened to the end of the core and situated adjacent to the metal product to be heated. Each pole shoe 7 has a flat polar surface parallel to one of the wide faces of the metal product to be heated. As shown in FIG. 3, the polar surface of each pole shoe 7 is in the shape of a curvilinear triangle comprising a truncated apex 8 directed toward the axis of rotation z of the inductor, two concave sides 9 and 10, symmetrical with respect to a straight line passing through the apex 8 and perpendicular to the axis z, and a convex side 11 consisting of a circular arc centered on the axis z and having a radius of curvature essentially equal to the external radius R of the annular zone 5 swept by the polar surfaces.

Figure 4:
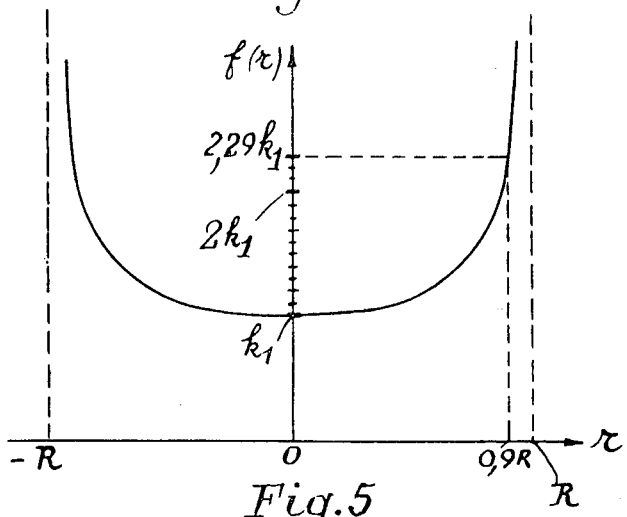
FIG. 4 is a diagram showing the ideal law of the variation of surface power induced by the heating apparatus in the metal product to be heated as a function of the distance of the axis of rotation from the inductor or inductors to obtain homogeneous heating over the entire width of the metal product.

With the polar surfaces in the shape of curvilinear triangles described above, it is possible to obtain a heating profile in the transverse direction that is more uniform than that obtained with the magnetic poles used in the previously known heating devices having either circular or square surfaces. This may be explained in the following manner. To a first approximation, neglecting the effects of the finite length and width, the surface power induced by the rotating inductor at a given point P of the metal product to be heated may be considered a function only of the distance r of said point from the axis of rotation z of the inductor. With reference to FIG. 4, it may be shown that a homogeneous heating of the moving metal product, having a half-width between O and R (R being the maximum action radius of the inductor, i.e. the external radius of the annular zone swept by the magnetic poles 4), may be obtained if the surface power assumes the form of an increasing function of the aforementioned distance r. This function may be expressed by the following relationship:

$$f(r) = \frac{k_1}{\sqrt{R^2 - r^2}} \tag{1}$$

wherein $k_1$ is a constant.

Figure 5:
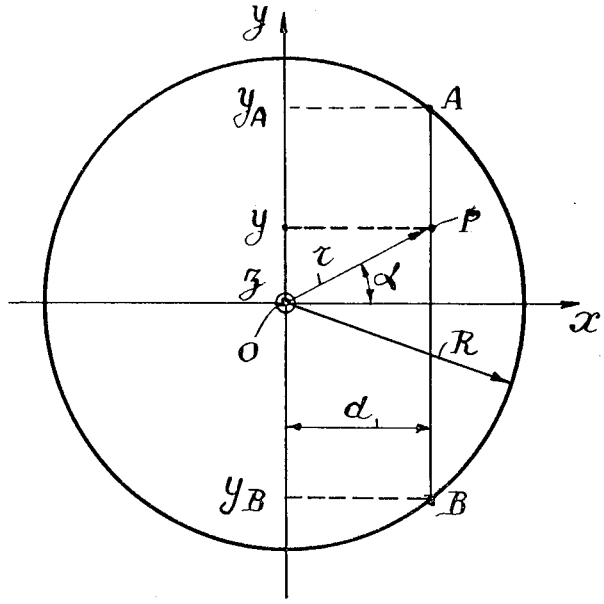
FIG. 5 is a diagram explaining the derivation of the law of FIG. 4; and, FIG. 5 is a diagram showing the variation in time of the magnetic field at a given distance from the axis of rotation of the inductor or inductors of the heating apparatus.

In effect, from the abovementioned hypothesis, the average energy $E_m(d)$ induced at the point P (see FIG. 5), which is moving along the segment AB at a distance d from the axis Oy is proportional to:

$$E_m(d) = \int_{y_B}^{y_A} f(r)dy \tag{2}$$

with $$r = \sqrt{d^2 + y^2} \tag{3}$$

$$y_A = \sqrt{R^2 - d^2} = -y_B \tag{4}$$

or:

$$E_m(d) = 2\int_0^{\sqrt{R^2 - d^2}} f(\sqrt{d^2 + y^2})dy \tag{5}$$

To obtain homogeneous heating over the width, it is necessary that the average energy $E_m$ at a distance d does not depend on said distance d. That is:

$$E_m(d) = \text{constant} \tag{6}$$

The solution of Equations (5) and (6) is provided by Equation (1). In fact, in view of Equations (1) and (3), Equation (5) may be written:

$$E_m(d) = 2\,k_1 \int_0^{\sqrt{R^2 - d^2}} \frac{dy}{\sqrt{R^2 - d^2 - y^2}} \tag{7}$$

from which:

$$E_m(d) = 2\,k_1 \left[ \text{arc sin} \frac{y}{\sqrt{R^2 - d^2}} \right]_0^{\sqrt{R^2-d^2}} \tag{8}$$

from which:

$$E_m(d) = 2k_1[\text{arc sin } 1 - \text{arc sin } 0] = \text{Constant} \tag{9}$$

which yields an $E_m$ independent of d.

FIG. 4 shows the curve representing the function f(r) defined by Equation (1) for r comprised between −R and +R. It may be seen from this curve that in order to obtain homogeneous heating over the entire width of the metal product having a width equal to 2R, (i.e. equal to the diameter of the annular action zone of the inductor) the surface power induced must theoretically have an infinite value at the periphery of the annular zone. This obviously is impossible to obtain in practice. In actual practice, for a maximum given width of the metal products to be heated, it suffices to dimension the inductor so that its action radius R is slightly larger than one-half of the maximum given width of the product 3 to be inductively heated. The curve representing the variation of the surface power induced as a function of the distance r under these circumstances has a configuration similar to the curve of FIG. 4 but with finite values of power for values of r adjacent to R.

Figure 6:
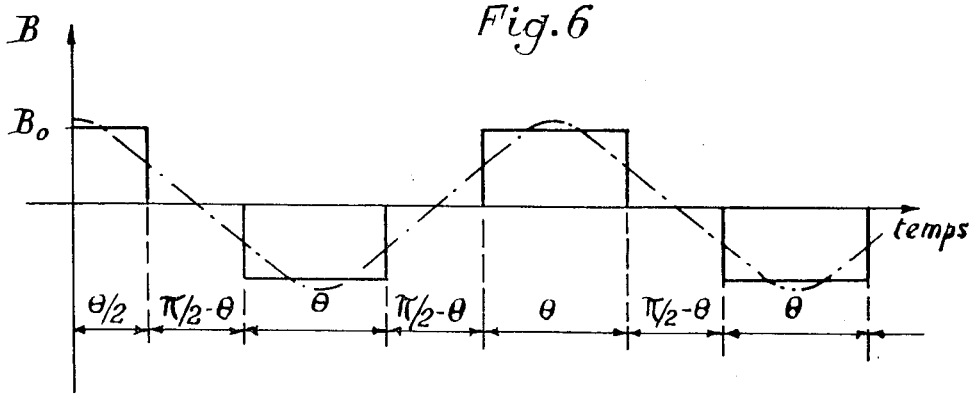

If one assumes that the magnetic field under each pole 4 of the inductor is uniform, and that the metal product to be heated is limited to the action zone of the inductor and that the induced reaction is negligible, the variation in time of the magnetic field B seen at the point P with the polar coordinates r, $\alpha$ (FIGS. 3 and 5) during the rotation of the inductor, may be represented by a succession of alternatingly positive and negative peaks, as shown in FIG. 6. Each peak corresponds to the passage of a pole 4 in front of the point P and to a width corresponding to the length of the polar arc $\theta$ (FIG. 3) of each pole 4 at a distance r at which the point P is located. This wave form of the magnetic field B viewed from the point P may be expanded into a Fourier series and expressed by the relationship:

$$B(t, \theta, \alpha) = \tag{10}$$

$$B_0 \sum_{p=0}^{p=\infty} \frac{4}{\pi} \frac{1}{2p+1} (-1)^p \sin(2p+1)\frac{\theta}{2} \sin(2p+1)(\omega t - \alpha)$$

Assuming for the sake of simplicity that the surface power induced at the point P is proportional to the square of the amplitude of the fundamental component of the magnetic field, then the eariler requirement for the homogeneous heating of a moving metal product may be expressed by the following equation:

$$f(r) = \frac{K_1}{\sqrt{R^2 - r^2}} = k_2 A_0^2 \tag{11}$$

wherein $k_2$ is a proportionality constant and $A_o$ is the amplitude of the fundamental component of the field. $A_o$ may be obtained from Equation (10) by setting p=0, or:

$$B = \underbrace{\frac{4\,B_0}{\pi} \sin\frac{\theta}{2}}_{A_0} \sin(\omega t - \alpha) \tag{12}$$

Equation (11) may then be expressed as:

$$\sin^2\frac{\theta}{2} = \frac{\pi^2}{16\,B_0^2} \cdot \frac{k_1}{k_2} \cdot \frac{1}{\sqrt{R^2 - r^2}} \tag{13}$$

which may also be written as:

$$\theta = 2 \text{ Arc sin} \frac{K}{\sqrt[4]{R^2 - r^2}} \tag{14}$$

with $$K = \frac{\pi}{4\,B_0} \sqrt{\frac{k_1}{k_2}} \tag{15}$$

It may be seen that, according to Equation (14), the length of the polar arc $\theta$ of each magnetic pole 4 at a distance r from the center O of the inductor is an increasing function of the distance r, resulting in the concave shape of the side 9 and 10 of each of the pole shoes 7 (FIG. 3).

With the aid of the above equations and by neglecting the edge effects it is possible to determine for a given width of metal products to be heated a theoretical form at the polar surface required to obtain homogeneous heating over the entire width of the metal product to be heated. Taking into account the edge effects, which depend on the rotating velocity, the number and form of the poles, the physical characteristics of the metal products to be heated, and the value of the air gap, is very complicated. Edge effects, however, may be taken into consideration by modifying in an iterative manner the theoretical form determined by calculation for a given width of metal products. For reasons for simplicity of manufacturing, it is possible to adopt for the polar surface of each of the pole shoe 7 the shape of a curvilinear triangle, the sides 9 and 10 of which are circular arcs having a profile approaching the ideal profile determined in the above-described manner, and the convex side 11 of which is a circular arc having a radius of curvature essentially equal to the external radius of the annular zone swept by the poles 4, this external radius itself being slightly larger than one-half of the maximum width of the metal products to be heated. Furthermore, in order to obtain a better equilibrium of the rotating masses, each polar surface in the shape of a curvilinear triangle is preferably symmetrical with respect to a straight line passing through its apex 8 and the center O of the rotating inductor. Further, as shown in FIG. 3, the apex 8 of each curvilinear triangle is preferably truncated to prevent the leakage magnetic flux between the poles of opposing polarity.

It is evident that the above-described modes of embodiment are merely examples and that they may be modified, in particular by the substitution of technical equivalence, without departing from the scope of the invention.

What is claimed is:

1. Apparatus for the magnetic induction heating of rectangular, flat metal products, traveling in the direction of their longitude, comprising:

at least one inductor capable of producing a controllable magnetic field of constant intensity oriented essentially perpendicular to a wide face of the metal product to be heated, the inductor being mounted so as to rotate about an axis perpendicular to the wide face of the metal product, the inductor comprising at least two magnetic poles each having a polar surface oriented toward the wide face and parallel to it and sweeping an annular zone when the inductor is rotating, the polar surface of each pole having the shape of a curvilinear triangle having an apex directed toward the axis of rotation of the inductor, the polar surface having two concave sides which are symmetrical with respect to a straight line passing through the apex and perpendicular to the axis and a convex side of a circular arc centered on the axis, the radius of curvature of the convex side being essentially equal to the external radius of the annular zone swept by the polar surfaces of the poles.

2. Heating apparatus according to claim 1, wherein each pole comprises a core surrounded by a coil and equipped with a pole shoe, characterized in that said polar surface in the shape of a curvilinear triangle is the polar surface of the pole shoe of the pole considered.

3. Heating apparatus according to claim 1, wherein the apex is truncated.

4. Heating apparatus according to claim 1, wherein the concave sides have the configuration of a circular arc.

5. Heating apparatus according to claim 4, wherein said apex is truncated.

* * * * *